US009969587B2

(12) United States Patent
Macura et al.

(10) Patent No.: US 9,969,587 B2
(45) Date of Patent: May 15, 2018

(54) WEB MATERIAL UNWIND APPARATUS

(71) Applicant: The Procter & Gamble Company, Cincinnati, OH (US)

(72) Inventors: Matthew Joseph Macura, Loveland, OH (US); Rong Deng, Mason, OH (US); Craig Allen Powell, Independence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 542 days.

(21) Appl. No.: 14/669,489

(22) Filed: Mar. 26, 2015

(65) Prior Publication Data

US 2016/0060060 A1 Mar. 3, 2016

Related U.S. Application Data

(63) Continuation-in-part of application No. 14/669,414, filed on Mar. 26, 2015, which is a (Continued)

(51) Int. Cl.
*B65H 19/12* (2006.01)
*B65H 16/04* (2006.01)
(Continued)

(52) U.S. Cl.
CPC ..... *B65H 19/12* (2013.01); *B65H 16/04* (2013.01); *B65H 16/10* (2013.01); *B65H 19/123* (2013.01);
(Continued)

(58) Field of Classification Search
CPC ..... B65H 19/12; B65H 75/242; B65H 16/10; B65H 16/04; B65H 19/123; B65H 2511/10; Y10S 901/30; Y10S 901/02
See application file for complete search history.

(56) References Cited

U.S. PATENT DOCUMENTS 2,268,887 A * 1/1942 Matteson ..... B21C 47/34 242/559
3,836,089 A 9/1974 Riemersma et al.
(Continued)

FOREIGN PATENT DOCUMENTS

CN 102648139 A 8/2012
EP 0577986 B1 9/1999
(Continued)

OTHER PUBLICATIONS

PCT International Search Report, dated Jan. 28, 2016, 116 pages.

*Primary Examiner* — William A. Rivera
(74) *Attorney, Agent, or Firm* — Sarah M. DeCristofaro; Andrew J. Hagerty

(57) ABSTRACT

An unwind apparatus for obtaining, loading, splicing, and unwinding convolutely wound rolls of web material and forwarding the web material unwound from each of the convolutely wound rolls uninterruptedly to a downstream apparatus is disclosed. The unwind apparatus provides for a multi-axis robot and an end effector operatively connected to the multi-axis robot. The end effector provides for a stationary motor, a rotational coupling mechanically coupled to the stationary motor, and, a mandrel mechanically coupled to the rotational coupling. The mandrel is capable of releasably engaging the convolutley wound rolls of web material.

21 Claims, 8 Drawing Sheets

Related U.S. Application Data continuation-in-part of application No. 14/471,315, filed on Aug. 28, 2014.

(51) Int. Cl.
*B65H 16/10* (2006.01)
*B65H 75/24* (2006.01)

(52) U.S. Cl.
CPC ..... *B65H 75/242* (2013.01); *B65H 2511/10* (2013.01); *Y10S 901/02* (2013.01); *Y10S 901/30* (2013.01)

(56) References Cited

U.S. PATENT DOCUMENTS

| | | | | |
|---|---|---|---|---|
| 4,331,418 | A | 5/1982 | Klebe | |
| 4,726,725 | A | 2/1988 | Baker et al. | |
| 4,733,576 | A | 3/1988 | Zimmer et al. | |
| 5,209,247 | A | 5/1993 | Rittershaus et al. | |
| 5,248,109 | A | 9/1993 | Berger et al. | |
| 5,289,985 | A | 3/1994 | Cocchi et al. | |
| 5,305,652 | A | 4/1994 | Zimmer | |
| 5,487,638 | A | 1/1996 | Salsburg et al. | |
| 5,608,818 | A | 3/1997 | Chini et al. | |
| 6,082,797 | A * | 7/2000 | Antonette | B25J 9/104 294/103.1 |
| 6,354,644 | B1 * | 3/2002 | Zaguroli, Jr. | B65H 19/123 294/67.22 |
| 6,678,583 | B2 * | 1/2004 | Nasr | B25J 9/046 206/710 |
| 6,685,130 | B2 | 2/2004 | Stauber et al. | |
| 6,731,091 | B2 | 5/2004 | Hietmann et al. | |
| 6,733,058 | B1 * | 5/2004 | Nakajima | B65H 19/123 242/559.1 |
| 6,736,348 | B1 | 5/2004 | Formon et al. | |
| 6,767,318 | B2 | 7/2004 | Spatafora et al. | |
| 6,978,964 | B2 | 12/2005 | Beccari | |
| 7,350,740 | B2 | 4/2008 | Benvenuti et al. | |
| 7,984,603 | B2 * | 7/2011 | Freudenberg | B65H 19/123 242/559 |
| 8,219,245 | B2 | 7/2012 | Merk et al. | |
| 2006/0051185 | A1 | 3/2006 | Spatafora | |
| 2006/0182595 | A1 * | 8/2006 | Lundstrom | B25J 9/0009 414/695.8 |
| 2010/0047050 | A1 | 2/2010 | Barsacchi | |
| 2013/0056576 | A1 | 3/2013 | Andrews et al. | |
| 2015/0090831 | A1 | 4/2015 | Huber et al. | |

FOREIGN PATENT DOCUMENTS

| | | | |
|---|---|---|---|
| EP | 2412348 | B1 | 3/2014 |
| JP | 2005/138938 | A | 6/2005 |

* cited by examiner

WEB MATERIAL UNWIND APPARATUS

FIELD OF THE INVENTION

The present disclosure relates generally to equipment suitable for continuously forwarding a web material, such as polyethylene into a web consuming apparatus such as a converter used for manufacturing disposable absorbent articles such as diapers and catamenial devices. The present disclosure relates more particularly relates to multi-axis robots suitable for use with an apparatus for continuously forwarding a web material, such as polyethylene into a web consuming apparatus such as a convener used for manufacturing disposable absorbent articles such as diapers and catamenial devices. The present disclosure more particularly relates to a unique end effector mechanism adapted to be attached to a multi-axis robot suitable for the un-assisted loading and unloading of a convolutley wound roll of web material taken from a supply of the convolutely wound rolls to a position where unwinding the convolutely wound material can produce disposable absorbent articles such as diapers and catamenial devices.

BACKGROUND OF THE INVENTION

In order to continuously supply a web consuming apparatus with web from a succession of rolls of web material, each new roll must be spliced to the preceding roll. Desirably, this is done without diminishing the rate of forwarding web to the web consuming apparatus. As such, a continuous supply of convolutely wound rolls of web material must be supplied to the apparatus from a web material unwind apparatus in order to maintain the manufacturing speeds necessary for the production of disposable absorbent articles such as diapers and catamenial devices.

Today, in most manufacturing sites, manual operation remains the most common method for material handling and delivery. In most operations, the assembled products materials are processed on-line as webs and a vast majority of these web materials are brought to the line as planetary rolls of convolutely wound rolls of web material.

Heretofore, multi-axis robots having end effector mechanisms or gripper mechanisms have been utilized in a number of manufacturing operations for gripping an article in one location, transporting the article to another location and releasing the article. These multi-axis robots have been effective in facilitating such manufacturing operations and saving labor costs with respect to heretofore performed manual operations. Notwithstanding, such multi-axis robots with end effector mechanisms have not been utilized to a great extent in assembled article manufacturing operations since conventional end effector mechanisms on such robots are normally designed for gripping rigid articles and will not function to grip convolutely wound web materials. Moreover, there is a need in many assembled product manufacturing operations, where the convolutley wound web materials are to be transported from one location to another and to maintain the convolutely wound web material or at least the leading edge thereof in a predetermined orientation.

There is also a compelling need to eliminate the manual effort required to stage, prepare, load, and thread up web materials to feed the converting equipment to manufacture assembled goods such as catamenial devices and diapers. There is a compelling need to reduce the floor space required for material staging, preparation, loading, and unwind convolutely wound materials, inclusive of automation. Further, there is a compelling need to enable a 'lights-out' web material supply solution that is nearly capital equal to current unwind operations. Additionally, there is a compelling need to support agile manufacturing principles on converting lines that enable easy reconfigurability. Thus, it would be beneficial to solve these challenges of footprint, effort, and cost simultaneously. The present description solves these challenges.

SUMMARY OF THE INVENTION

The present disclosure relates to an unwind apparatus for obtaining, loading, splicing, and unwinding convolutely wound rolls of web material and forwarding the web material unwound from each of the convolutely wound rolls uninterruptedly to a downstream apparatus. The unwind apparatus comprises a multi-axis robot and an end effector operatively connected to the multi-axis robot. The end effector comprises a stationary motor, a rotational coupling, mechanically coupled to the stationary motor, and, a mandrel mechanically coupled to the rotational coupling. The mandrel being capable of releasably engaging the convolutley wound rolls of web material.

The present disclosure also relates to an end effector for an unwind apparatus for obtaining, loading, splicing, and unwinding convolutely wound rolls of web material and forwarding the web material unwound from each of the convolutely wound rolls uninterruptedly to a downstream apparatus. The end effector comprises a stationary motor, a rotational coupling mechanically coupled to the stationary motor, and, a mandrel mechanically coupled to the rotational coupling. The mandrel being capable of releasably engaging the convolutley wound rolls of web material.

DETAILED DESCRIPTION

As will be described in detail, a web material unwind apparatus utilizing an exemplary multi-axis robot 10 and cooperatively engaged end effector 40 described herein can be used to deliver web materials to downstream manufacturing equipment. As is to be appreciated, a plurality of exemplary multi-axis robots 10 and cooperatively engaged end effectors 40 described herein can be configured to provide a web material unwind apparatus by all simultaneously supplying web materials to a single downstream manufacturing process and/or a plurality of downstream manufacturing processes. The web material unwind apparatus comprising an exemplary multi-axis robot 10 and cooperatively engaged end effector 40 described herein may be positioned in a manufacturing environment proximate to other manufacturing equipment. While no particular downstream equipment is shown, it will be understood by those of skill in the art that the continuous supply of web material from convolutley wound rolls of web material supplied by the exemplary web material unwind apparatus comprising a multi-axis robot 10 and cooperatively engaged end effector 40 could be advanced to a variety of web material handling processes, including without being limiting, laminating operations, printers, embossing operations, slitting operations, folding and cutting operations, converting operations, and the like, as well as combinations of these.

Figure 1:
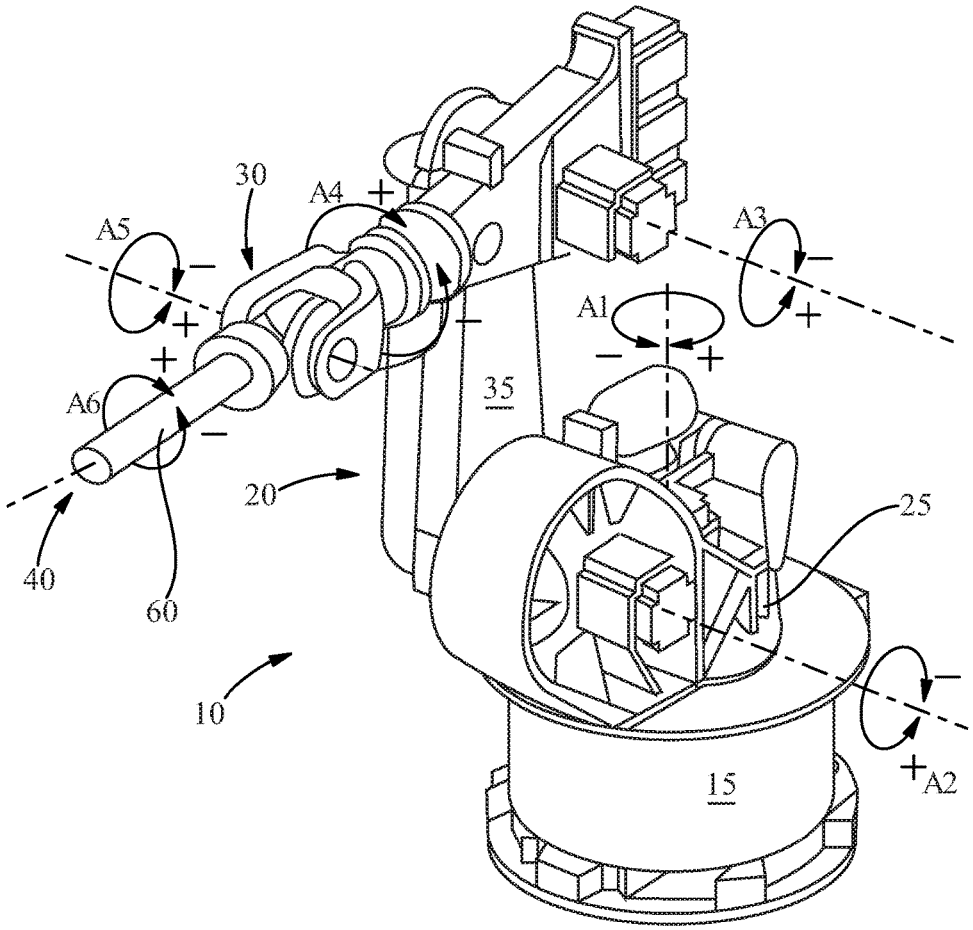
FIG. 1 is a perspective view of an exemplary multi-axis robot suitable for use as a web material unwind apparatus as described herein.
Figure 3:
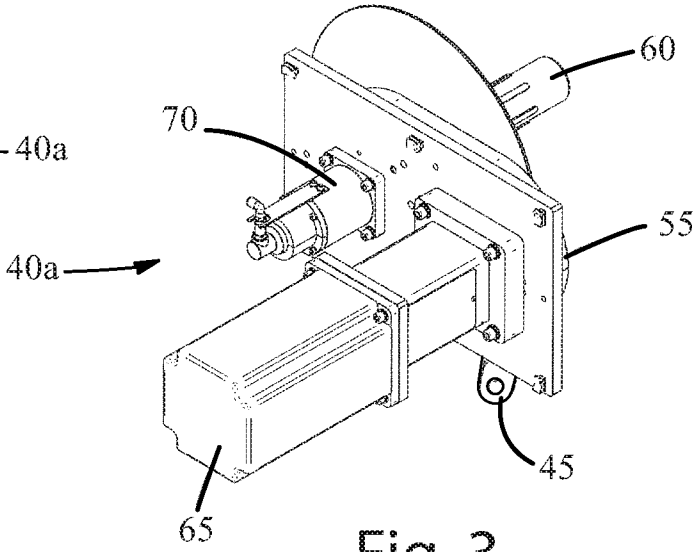
FIG. 3 is an alternative perspective view of the exemplary end effector of FIG. 2.
Figure 2:
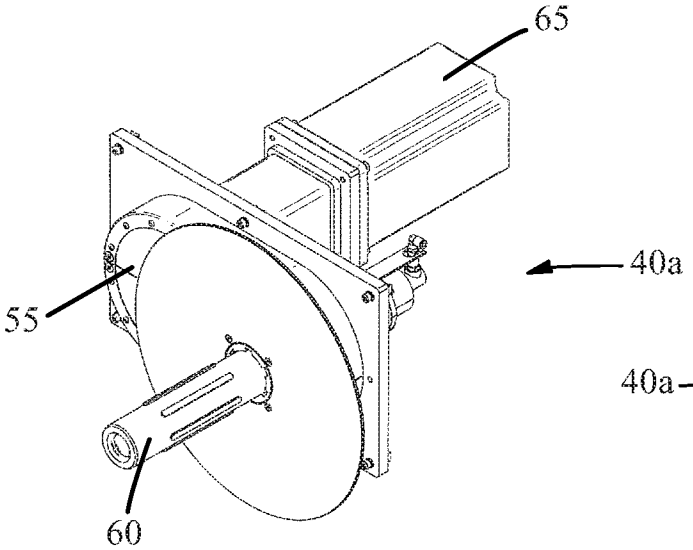
FIG. 2 is a perspective view of an exemplary end effector suitable for use with the multi-axis robot of FIG. 1 used for a web material unwind apparatus.
Figure 4:
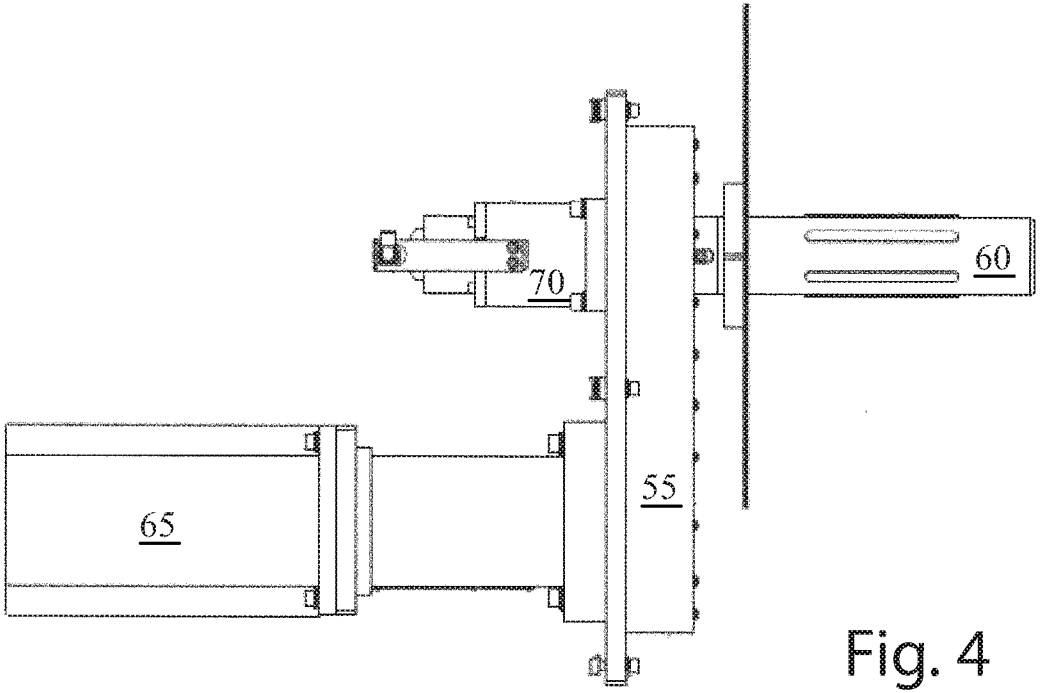
FIG. 4 is a plan view of the exemplary end effector of FIG. 2.
Figure 5:
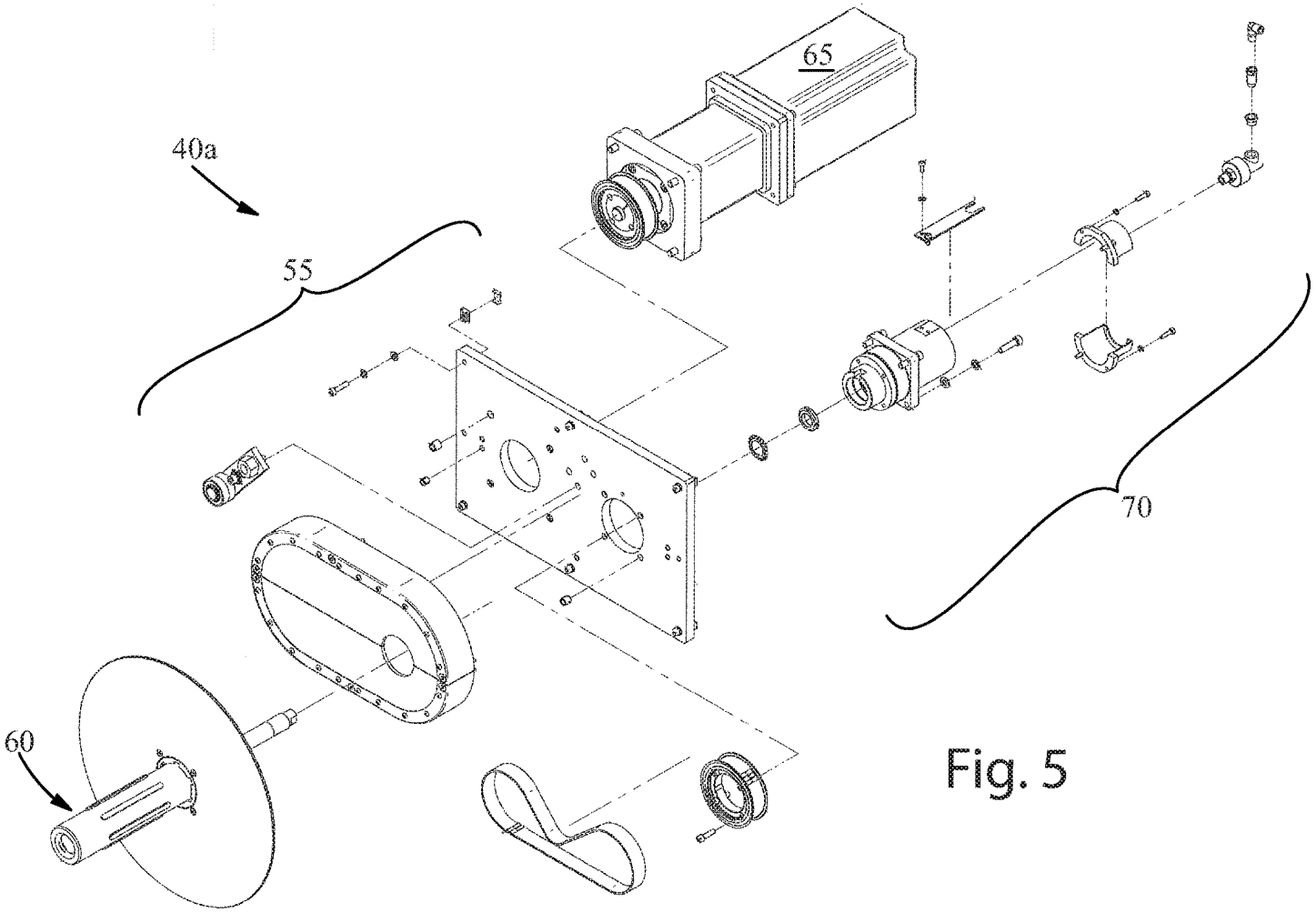
FIG. 5 is an exploded view of the exemplary end effector of FIG. 2.

In the embodiment shown in FIG. 1, the multi-axis robot 10 may be manufactured from any suitable material, such as steel, stainless steel, aluminum, cast iron, or composite materials, for example. The components comprising multi-axis robot 10 may also be assembled or constructed using any suitable techniques, such as welding, rivets, adhesives, or screws, for example to provide an assembled multi-axis robot 10.

An exemplary multi-axis robot 10 can be provided with an arm 20 (or an inter-connected plurality thereof), a wrist subassembly 30 and an end effector 40. An exemplary multi-axis robot 10 could utilize a Cartesian, cylindrical, polar, or revolute coordinate system to coordinate motion relative to the multi-axis robot 10 as well as the components of multi-axis robot 10 cooperatively associated thereto. By way of non-limiting example, a six-axis multi-axis robot 10 can be provided with 6 independent axis of rotation. As shown in FIG. 1, the 6 independent axis of rotation of the six-axis multi-axis robot 10 are shown as A1, A2, A3, A4, A5, and A6.

One of skill in the art will recognize that generally, three motion axes are employed to deliver the wrist subassembly 30 anywhere within the sphere of influence and three additional motion axes are employed for universal orientation of the end effector 40. A drive system can be used for each motion axis, and without limitation the drive system can be electrical, hydraulic or pneumatic.

The exemplary multi-axis robot 10 represented in the drawings provided herein consists of a mount 15, a rocker 25, an extension arm 35 (or an inter-connected plurality thereof), a wrist subassembly 30, as well as an end effector (also called a robot hand) 40 and can be provided with as many as six or seven rotary axes. The axes are different with respect to the swinging and rotating axes, whereby the swinging axes in the multi-axis robot 10 run crosswise to the extension of the robot 10 structure, and as a rule, horizontally. The swinging angles are for the most part also limited. The rotational axes generally extend lengthwise to the respective robot structure or in the vertical plane. They permit as a rule greater rotational angles than the swinging axes. Further, rocker 25 can rotate around one or several axes. Further, and by way of non-limiting embodiment, the multi-axis robot 10 can be arranged in any position, whereby it is, for example, mounted to a support, suspended at a portal, or can be attached to a frame structure.

Alternatively, multi-axis robot 10 could be provided as a Cartesian coordinate robot (also called a linear robot, or a gantry robot) as well as selective-compliance-articulated robot arms (SCARAs). Exemplary Cartesian coordinate robots and SCARAs can be used to move, relocate, position, and/or otherwise provide convolutely wound rolls of first and/or second web materials as required. Cartesian robots are mechatronic devices that use motors and linear actuators to position a tool. They make linear movements in three axes, X, Y, and Z. Physical scaffolding can form a framework that anchors and supports the axes and payload. Certain applications, such as machining tightly toleranced parts, require full support of the base axis, usually the X axis. In contrast, other applications, such as picking bottles off a conveyor, require less precision, so the framework only needs to support the base axis in compliance with the actuator's manufacturer recommendations. Cartesian-robot movements stay within the framework's confines, but the framework can be mounted horizontally or vertically, or even overhead in certain gantry configurations.

A gantry robot is a special type of Cartesian multi-axis robot whose structure resembles a gantry. This structure can be used to minimize deflection along each axis. Many large robots are of this type. The X, Y, and Z coordinates of a gantry robot can be derived using the same set of equations used for the Cartesian robot. One of skill in the art will understand that a SCARA and six-axis robots generally mount on a pedestal or are attached to a frame. SCARAs move in the X, Y, and Z planes like Cartesian robots, but incorporate a theta (θ) axis at the end of the Z plane to rotate the end-of-arm tooling.

One of skill in the art will recognize that the selection of a particular multi-axis robot 10 is evaluated by the application's needs. That can start with profiling the job's load, orientation, speed, travel, precision, environment and duty cycle, sometimes called LOSTPED parameters. First, a robot's load capacity (defined by the manufacturer) should exceed the total weight of the payload, including any tooling, at the end of the robot arm. Second, the Orientation depends on how the robot is mounted and how it situates parts or products being moved. One of skill in the art will understand that a goal is to match the robot's footprint to the work area. Additionally, one of skill in the art will consider part orientation. Third, speed and travel should be considered along with load and speed ratings. Fourth, industrial robots have predefined accuracy ratings that make it easy to determine their repeatability of movement. Precision can be key in high-end applications. Fifth, environmental factors can dictate the best robot for use. This can include the working envelope's ambient environment and hazards in the space itself. The pedestals of SCARA and six-axis robots can be compact, which is handy with limited floor space. Sixth, the amount of time it takes to complete one cycle of operation (i.e., duty cycle) should be considered. Robots that run continuously 24/7 (as in high-throughput screening and pharmaceutical manufacturing) reach end of life sooner than those running only 8-hr days, five days a week. Finally, a suitable robot for an application can also depend on the requirements for controls and programmability. All robot controls will preferably be able to interpolate point-to-point, linear, or circular movements through path following and programmed speed, acceleration, and deceleration parameters.

The multi-axis robot 10 may include a plurality of feet 22 arranged proximate the bottom side. As will be appreciated, the plurality of feet 22 may be adjustable in order to adjust the elevation of the multi-axis robot 10. Furthermore, the multi-axis robot 10 may comprise a cable tray for housing various power and communication cables. Other techniques may be used for housing the cables, such as conduits, for example.

More particularly, as shown in FIG. 1, a six-axis industrial electric multi-axis robot 10 which is illustrative of a wide variety of robots that can be operated in accordance with the principles of the present disclosure. An exemplary multi-axis robot 10 suitable for use as positionable roll grasping apparatus for obtaining, dispensing, and disposing of rolls of convolutely wound web materials is the model KR180L available from Kuka Robotics. By way of non-limiting example, the model KR180L has a 50-60 Kg payload capacity. The Model KR210L has an 80-90 Kg payload capacity and the model KR240L having a payload capacity of 110-120 Kg can also be suitable for use. Such multi-axis robots 10 can be particularly suited for precise, repetitive tasks.

As would be understood by one of skill in the art, control software can suitably operate a multi-axis robot 10 by incorporating absolute position feedback. A suitable multi-axis robot 10 control scheme can utilize a digital servo control. For example, a multi-axis robot 10 can be operated with a torque control loop. A position control loop can be connected to a velocity control loop which in turn can drive the torque control loop. A feed-forward acceleration control loop that is responsive to an acceleration command as well as arm and load inertia sensors can be directly coupled to the input of the torque control loop. Additionally, the multi-axis robot 10, extension arm(s) 35, rocker 25, wrist subassembly 30, and end effector (robot hand) 40 can be operated by the control loop in accordance with a robot program through a stream of program position commands applied to the position control loop. In any regard, it can be preferable to implement such a control loop as a digital control.

A preferred control loop arrangement could provide position and velocity control loops and to be parallel fed to the input of a torque control loop. Velocity commands can be generated from position commands. In turn, feed-forward acceleration commands can be generated from the velocity commands. Computed inertia (extension arm(s) 35, rocker 25, wrist subassembly 30, end effector 40, and the applied load) can be multiplied against the acceleration command in the feed-forward acceleration control loop.

A velocity command generator can interpolate velocity commands which correspond with the velocity feedback sampling rate in a velocity feedback path. Similarly, in a position control loop, an interpolator can generate position commands in correspondence with a feedback path. Velocity error can be generated by a summer with gain applied by a loop. Similarly, a position error can be generated by a summer. Velocity and position errors and feed-forward acceleration command can be summed in a summer. Gain can be applied to generate a torque command that is applied to the input of a torque control loop. The torque error can generated in a summer by summing the torque command (motor current command) with current feedback and applying a torque loop gain to the torque error and output commands (motor voltage commands) that supplies the motor drive current for multi-axis robot 10 joint operation.

The various components of the multi-axis robot 10 may be powered by any motive force known in the art, collectively referred to herein as "actuators." Power sources include, without being limiting, standard and servo electric motors, air motors, and hydraulic motors. The power source may be coupled to any rotating components of the multi-axis robot 10 by any power transfer means known in the art, such as direct coupling the actuator to the rotating component, driving the rotating component through the use of chains and sprockets, belts and sheaves, and gearing, for example. The actuators may extend into the multi-axis robot 10. Various power and communication cables may be attached to the actuators inside the cavity.

Additionally, it is envisioned that multi-axis robot 10 and/or end effector 40 can automatically and/or autonomously determine any characteristic of a roll of web material such as the diameter of a roll of web material, the diameter of a core region of a roll of web material, the type of material comprising a roll of web material, a physical characteristic of a roll of web material, or the like through computer control or programming as would be available to one of skill in the art. It is believed that such a determination could be beneficial in allowing the multi-axis robot 10 to automatically and/or autonomously select an appropriate end effector 140 provided from a selection of available end effectors 40. By way of non-limiting example, if the multi-axis robot 10 (or any ancillary component of multi-axis robot 10) determines that a particular roll of web has a diameter of 1 meter and a core diameter centrally disposed thereto has a diameter of 10 cm, any control software, programming, or other PLC code could direct the multi-axis robot 10 to obtain an appropriately sized end effector 40 from a store of end effectors 40. Alternatively, if multi-axis robot 10 has a particular end effector 40 disposed thereon and the control software, programming, or other PLC code determines that an end effector 40 disposed upon and in connective and cooperative engagement with, multi-axis robot 10 is incorrectly sized for the roll of web material, the control software, programming, or other PLC code could direct the multi-axis robot 10 to return the end effector 40 currently disposed thereon to a store of end effectors 40 and select a new and/or appropriate end effector 40 for the particular roll of web material. It is believed that such an ability to change end effectors 40 'on-the-fly' would necessarily increase the flexibility of a manufacturing process as well as decrease the amount of time needed to change production of articles from one type requiring one type of web material to another.

The end effector 40 of a multi-axis robot 10 may further comprise roll grasping means in the form of a mandrel 60 (also known as a "spindle") and/or idler rollers capable of providing, engaging and directing a convolutley wound web material disposed upon and/or about mandrel 60 into cooperative and connective engagement with any of the components used to manufacture assembled goods. A mandrel 606 can manifest itself as end effector 40 disposed upon multi-axis robot 10.

Figure 6:
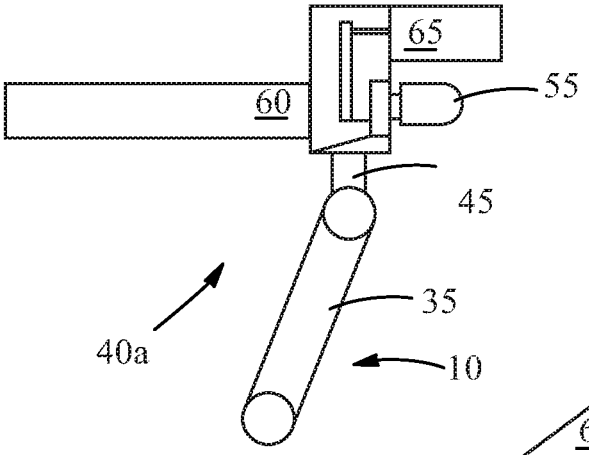
FIG. 6 is an elevational view of the exemplary end effector of FIG. 2 that is operatively connected to an articulable arm of a multi-axis robot.
Figure 7:
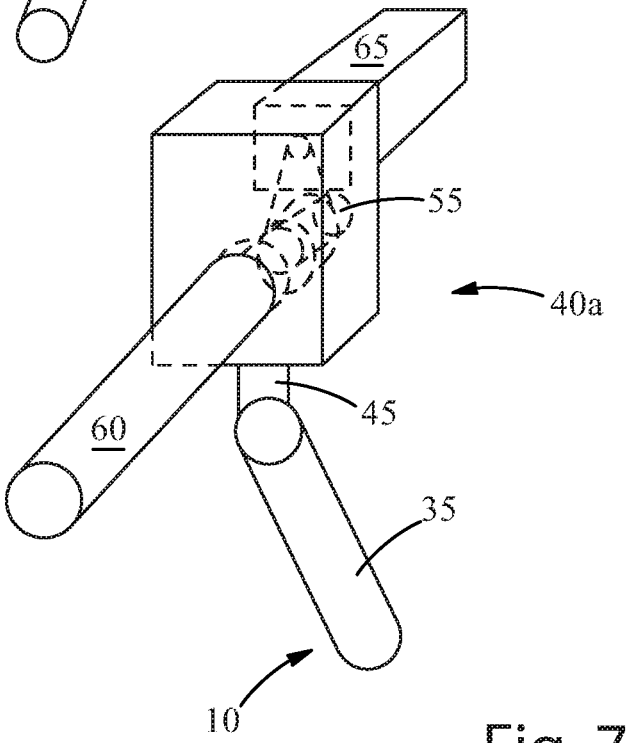
FIG. 7 is a perspective view of the exemplary end effector of FIG. 2 operatively connected to an articulable arm of a multi-axis robot.

One embodiment of an exemplary end effector **40*a* is illustrated in FIGS. 2-5. FIGS. 2-5 are various perspective, plan, and exploded views of the end effector 40*a* suitable for use as a mandrel for unwinding convolutely wound rolls of web material that can be conjoined to multi-axis robot 10 in accordance with one non-limiting embodiment. Further, as shown in FIGS. 6-7, end effector 40*a* can be attached to multi-axis robot 10 electrically, mechanically, magnetically, or any other means of attachment known to those if skill in the art through mounting bracket 45**.

End effector **40*a* can be coupled to a rotational coupling 55. As would be understood by one of skill in the art, rotational coupling 55 can provide the enablement of a rotational mandrel 60 with a stationary motor 65. By way of non-limiting example, a suitable rotational coupling 55 can comprise a housing that is essentially two bearings operatively disposed within a fixed outer metal block that is mounted to the stationary motor 340 and robot 115**. Suitable bearings are available from SKF as BEARING D25X52X15-SKF W 6205.2RSL.

Additionally, end effector 40*a* can utilize rotational coupling 55 to provide any required power, pneumatics, and the like to the mandrel 60 necessary to hold a convolutely wound roll of web material. By way of non-limiting example, a suitable pneumatic coupling could be provided as a through bore or an end-cap style. If so desired, it may also be useful to use an offset pulley and/or drive system to enable pneumatic coupling. Such a component can be provided as ROTATING JOINT—PART NO. R.037, available from OMPI S.R.L., DENVER, COLORADO. It was found that an end cap style pneumatic coupling was suitable with for use as rotational coupling 55 as well as providing an off-set stationary motor 65 (and accompanying drive shaft). Such an off-set design could be provided by one of skill in the art through a belt/pulley system. This arrangement could result in a need for less space as may be conventionally required for end effector 40*a*.

One of skill in the art would find that a suitable motor 65 is available from Rockwell, Incorporated and is identified as an MPM Motor, MultiTurn Encoder, SpeedTec, With Brake, 7.2 Kw, 3000 RPM, Rockwell Part ##MPM-B2153F-MJ74AA. Those of skill in the art will realize the need to also any supply drives, cables, converters, adapters, and the like that can facilitate connection of the stationary motor 65 to be connected to, and controlled by, a logic processor. Such additional components suitable for use with the specified motor 65 can include: Power cable from drive to plug board, Motor Power Cable, SpeedTec Din, w/Brake 2M, Rockwell Part #2090-CPBM7DF-08AF02; Power Cable front plug board to motor, Motor Power Cable, SpeedTec Din, w/Brake 10M (Patch Cable), Rockwell Part #2090-CPBM7E7-08AA10, Feedback back from drive to plug board, Motor Feedback Cable, SpeedTec Din 2M, Rockwell Part #2090-CFBM7DF-CDAF02; Feedback cable form plug board to motor, Motor Feedback Cable, SpeedTec Din 10M (Patch Cable), Rockwell Part #2090-CPBM7DF-08AF02; Bulkhead Adapter Kit for Feedback Cable, Rockwell Part #2090-KPB47-12CF; and, Bulkhead Adapter Kit for Power Cable, Rockwell Part #2090-KPB47-06CF. A suitable drive for motor 65 is available from Rockwell, Incorporated as: Kinetix 5500, Rockwell Part #2198H070ERS with ancillary equipment noted as Feedback converter for MPM motor, Rockwell Part #2198H2DCK, Control power connector, Rockwell Part ##2198H070PT, and DC Bus Connector, Rockwell Part ##2198H070DT.

It is believed that if a mandrel 60 is provided as an end effector (robot hand) 40, mandrel 60 can be provided with a unique device that provides for the ability to transfer convolutely wound rolls of web materials without the need for compressional forces applied to the external convolutions of the wound web materials. One of skill in the art will understand that because of the compressible nature of the web materials, it is quite common for parent rolls to become out-of-round Not only the soft nature of the web material, but also the physical size of the rolls, the length of time during which the rolls are stored, how the rolls are stored (e.g., on their end or on their side), and the fact that 'roll grabbers' used to transport these rolls clamp the roll generally about the circumference all can contribute to this problem. As a result, by the time many rolls are placed on an unwind stand for converting, they have changed from the desired cylindrical shape to an 'other-than-round' (e.g., out-of-round) shape.

In extreme cases, rolls can become oblong, assume an 'egg-like' shape, or even resemble a flat tire. But, even when the roll is only slightly out-of-round, there are considerable problems. In an ideal case, as material is removed from a completely round, convolutely wound roll, the feed-rate, web velocity, and tension will generally be consistent. However, process disturbances such as the feed-rate variability, web velocity variability, and tension variability for an out-of-round, convolutely wound roll, caused by the shape changes created by the storage and handling of rolls, will likely vary the material removal from the ideal web speed of a completely round roll depending upon the position and/or radius at the web takeoff point at any moment in time.

If the rotational speed of the roll remains substantially constant, the feed-rate, web velocity, and tension of the web material coming off of an out-of-round roll will vary during any particular rotational cycle. Naturally, this depends upon the degree to which the roll is out-of-round. Since the paper converting equipment downstream of the unwind stand is generally designed to operate based upon the assumption that the feed-rate, web velocity, and tension of web material coining off of a rotating roll is generally consistent with the driving speed of the roll, web velocity, and/or tension spikes, and/or slackening during the unwinding process can cause significant problems. With an out-of-round roll, such process disturbances cause the instantaneous feed-rate, web velocity, and/or tension of the web material to be dependent upon the relationship at any point in time of the radius at the drive point and the radius at the web takeoff point.

Clearly, there is a need to overcome this problem of causing out-of-round convolutely wound rolls of web material. Particularly, out-of-round rolls create variable web feed rates and corresponding web tension spikes and web tension slackening that have required that the unwind stand and associated paper converting equipment operating downstream thereof be run at a slower speed. In many instances this creates an adverse impact on manufacturing efficiency. Providing an end effector 40 as discussed herein can obviate these aforementioned drawbacks.

Figure 8:
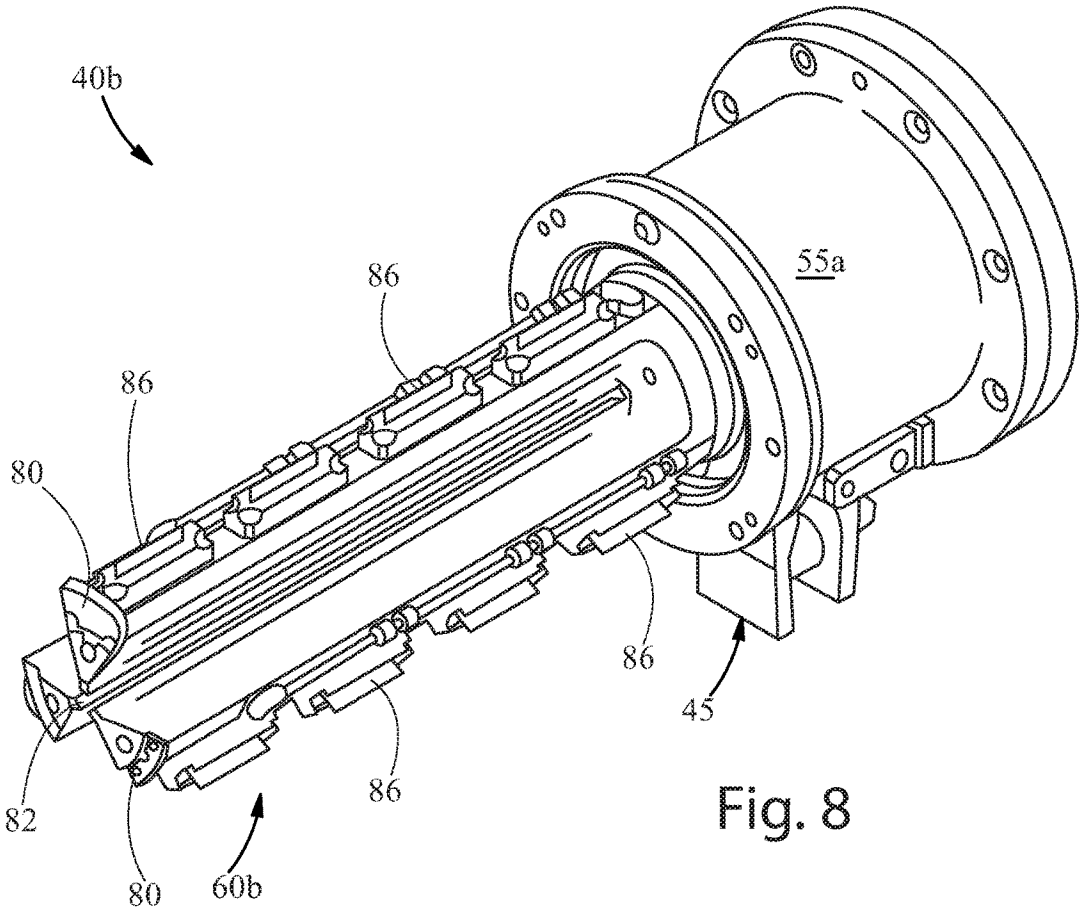
FIG. 8 is a plan view of an exemplary mandrel suitable for use with the exemplary end effector of FIG. 2.
Figure 9:
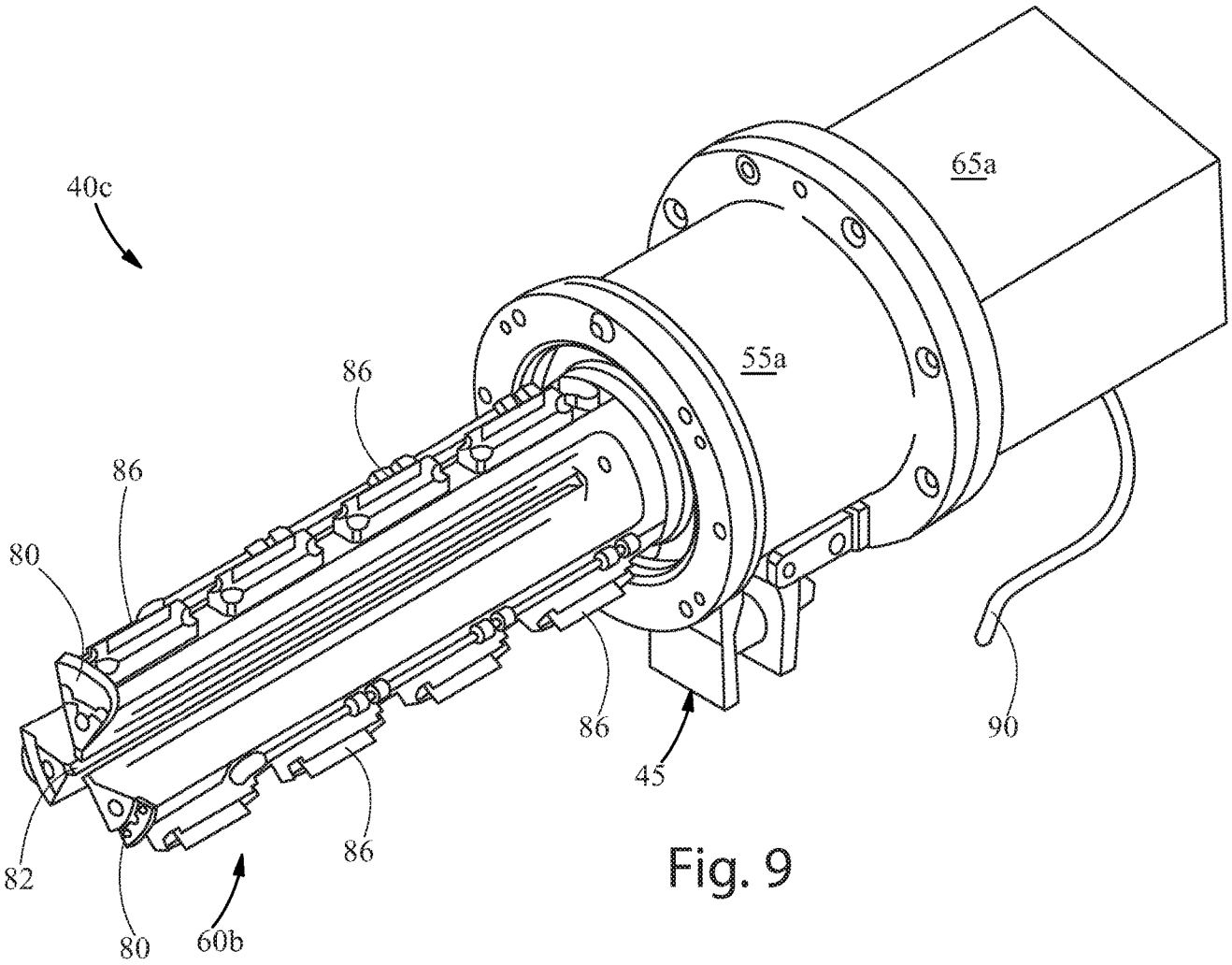
FIG. 9 is a plan view of another exemplary mandrel suitable for use with the exemplary end effector of FIG. 2; and, FIG. 10 is a perspective view of an exemplary web material unwind apparatus according to the present disclosure showing a plurality of positionable roll grasping apparatus in the form of the exemplary multi-axis robots of FIG. 1 and having the exemplary end effector of FIG. 7 disposed thereon, each having a convolutley wound web material disposed thereon adjacent a first lattice.

FIG. 8 provides a perspective view of an exemplary mandrel 60*b* suitable for use with an exemplary end effector 40*b* for obtaining, unwinding, and disposing of the remains of convolutely wound rolls of web material that can be conjoined to robot 10. By non-limiting example, end effector 40*b* is provided with a mandrel 60*b* having a plurality of elongate mandrel arms 80 disposed radially about the longitudinal axis 82 of mandrel 60*b* and extending from rotational coupling 55*a*. Mandrel 60*b* can then be indirectly driven by stationary motor 65 through rotational coupling 55*a* as discussed supra. Alternatively, as shown in FIG. 9, a stationary motor 65*a* can be directly coupled to rotational coupling 55*a* for the purpose of driving elongate mandrel arms 80 of mandrel 60*b* of end effector 40*b*.

Each elongate mandrel arm 80 is provided with at least one expansion element 86, and in most cases a plurality of expansion elements 86 disposed upon the outer surface thereof. In principle, mandrel 60*b* is inserted into the hollow core area of a convolutley wound material. The associated expansion elements 86 associated with each mandrel arm 80 are then expanded radially away from longitudinal axis 82. The outward expansion of the expansion elements 86 is limited by the diameter of the hollow core area of the convolutely wound web material. Upon proper expansion of the expansion elements 86 against the hollow core of the convolutely wound web material, a compression fit is realized that effectively provides the mandrel 60*b* of end effector

40*b* having the convolutely wound web material attached thereto to freely move about and position the roll of convolutely wound web material be positioned as may be required.

As depicted, mandrel 60*b* can be provided as a suitable end effector 40*b* with three mandrel arms 80 arranged triangularly about longitudinal axis 82. Naturally, one of skill in the art could provide a mandrel 60*b* with any number of mandrel arms 80 disposed as required about longitudinal axis 82. For example, one of skill in the art could provide only two mandrel arms 80 or even four mandrel arms 80.

One surprising aspect of providing mandrel 60*b* as a plurality of mandrel arms 80 is the ability to interleave a pair of mandrels 60*b*. In other words, the mandrels arms 80 of opposed mandrels 60*b* can be disposed in an adjoining relationship so that the mandrel arms 80 of interlaced mandrels 60*b* are disposed radially and cooperatively about longitudinal axis 82 and in cooperative engagement with each other. A surprising benefit of such interleaving is the ability to effectively transfer a convolutley wound roll of web material disposed and locked upon a first mandrel 60*b* to be transferred to a second mandrel 60*b* upon the inter-engagement of the mandrel arms 80 of a first mandrel 60*b* and the mandrel arms 80 of a second mandrel 60*b*.

One of skill in the art will understand that the use of end effector 40*b*, the need to "hand-off" convolutely wound rolls of web material is eliminated. For example, multi-axis robot 10 and an end effector 40*b* cooperatively associated thereto can directly obtain a new convolutely wound roll of web material prior to any necessary process positioning to dispose to any downstream convening operations. Further, when the convolutely wound rolls of web material has been used to completion, multi-axis robot 10 and the end effector 40*b* cooperatively associated thereto can directly dispose of the old convolutely wound roll of web material and would requires no transfer of the convolutely wound roll of web material between equipment. One of skill in the art will recognize that the elimination of such a "hand-off" can result in the elimination of normally attributable manual operations resulting in productivity and cost savings. Ostensibly, this is because the use of a robotic unwind incorporating a so-called 'all-in-1' unwind, operation would naturally include elimination of such roll "hand-offs" resulting in the aforementioned efficiency and productivity. Additionally, it is envisioned that the use of an unwind incorporating multi-axis robot 10 and the end effector 40*b* cooperatively associated thereto can result in better management of any process space efficiency due to a multi-axis robot 10 being an integral part of any unwind operations. Further, one of skill in the art will readily appreciate the increased flexibility, repeatability, and reliability in the positioning of convolutely wound rolls of web material relative to any converting operations downstream from the multi-axis robot 10 unwinding operation.

It is believed that the respective expansion elements 86 can be expanded and contracted relative to the longitudinal axis 82 (i.e., expanded away from the longitudinal axis 82 or contracted toward the longitudinal axis 82) though the use of appropriate valving and fluid supply. Suitable fluids could be provided as a hydraulic control system or an air control system. In certain cases, it may be suitable to provide valves that can control and/or direct the flow of fluid to control a particular expansion element 330 or plurality of expansion elements 86 as may be required by the user. In any regard, it is preferred that the expansion elements 86 be expandable to the point of contacting engagement with the material defining the outside of the hollow core of the convolutley wound web material. The amount of contacting engagement should be sufficient to allow for the mandrel 60*b* provided as an end effector 40*b* of robot 10 provided as a mandrel 60*b* can effectively position or unwind a convolutley wound roll of web material without loss of control of the convolutley wound roll of web material.

Figure 10:
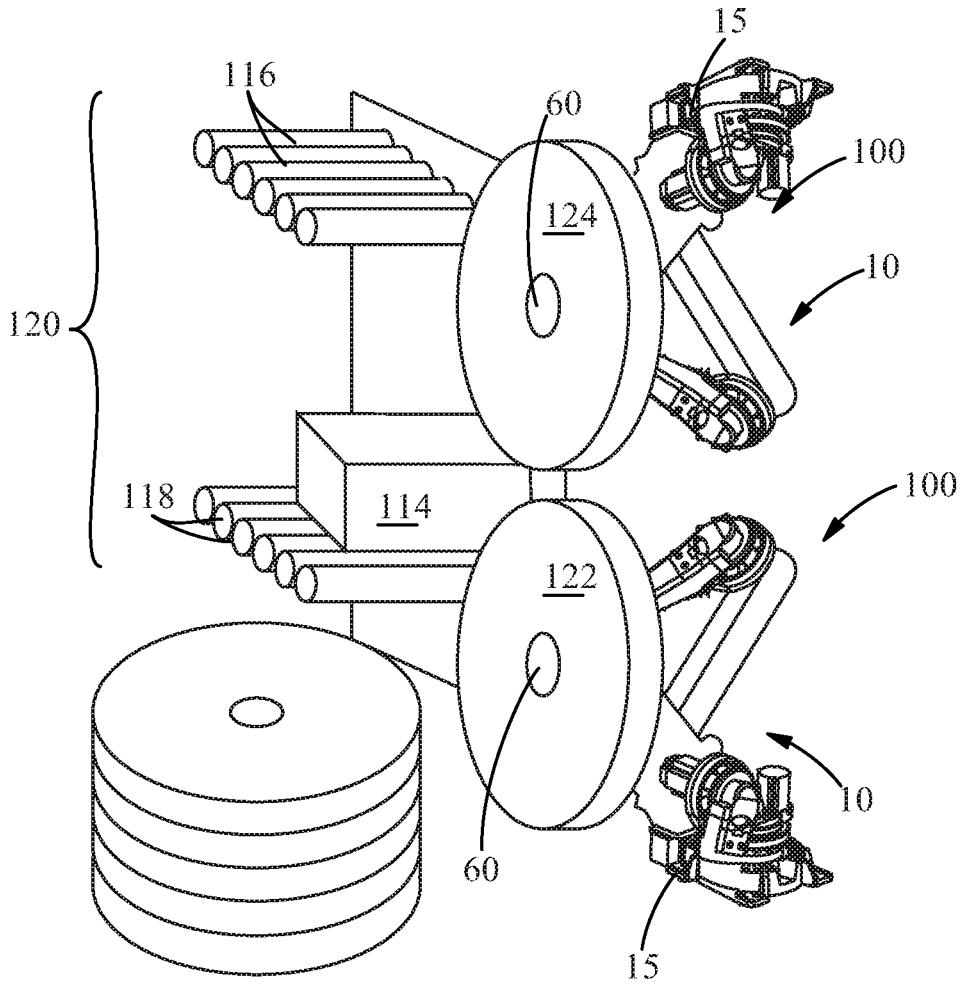

As shown in FIG. 10, multi-axis robot 10 having end effector 40 provided as mandrel 60 cooperatively associated thereto can be suitably used as a positionable roll grasping apparatus 100, or a plurality of positionable roll grasping apparatus 100. A unique feature of the with the multi-axis robot 10 as described supra is that a positionable roll grasping apparatus 100 so designed can be used to move, relocate, position, unwind, remove, and/or otherwise herein provide the various convolutely wound rolls of first and/or second web materials 122, 124 relative to any component generally associated with the converting of convolutely wound rolls of first and/or second web materials 122, 124 such as splicer 114, lattice 120, or even another convolutely wound roll of first and/or second web materials 122, 124 (generally referred to herein as "dispose"). It would be understood by one of skill in the art that a positionable roll grasping apparatus 100 in the form of a multi-axis robot 10 as described herein can provide capabilities that can generally range from simple repetitive point-to-point motions to complex motions that can be computer controlled and sequenced.

It is preferred that end effector 40 be constructed with respect to the kinematics required to move each of the convolutely wound rolls of web materials 122, 124 from a first location to a second location. This may require moving the wound web materials 122, 124 from a first location where the wound web materials are stored to a second location that places the web materials proximate to, or in contacting engagement with frame 112, or placing the web material comprising each of wound web materials 122, 124 proximate to or in contacting engagement with splicer 114 (or any number of splicers or other equipment associated with the production of disposable absorbent articles such as diapers and catamenial devices). For that matter, end effector 40 can move each of the convolutely wound rolls of wound web materials 122, 124 into any position or location that provides the wound web material 122, 124 in the most efficacious position required to manufacture the articles envisioned. Additionally, end effector 40 can be positioned relative to the splicer 114 (or any number of splicers or other equipment associated with the production of disposable absorbent articles such as diapers and catamenial devices) during the unwinding process. One of skill in the art will recognize that this can provide additional room for the placement of an additional wound web material within the space just evacuated by end effector 40 or the installation of additional manufacturing equipment that may be required for the production of disposable absorbent articles such as diapers and catamenial devices during the unwinding process.

Additionally, it is envisioned that end effector 40 can be constructed with respect to the kinematics required to remove the cores upon which the convolutely wound rolls of web materials 122, 124 are wound about. It is also envisioned that end effector 40 can be provided as a centrally constructed articulating hand. This can provide the end elector 40 with the three continuous and interlaced axes of rotation (movement). This may require providing as many drive shafts axes that extend inside the housing of arm 20. Each drive Shaft can be directly attached to a respective motor with cardan links. Such a multi-axis robot 10 can facilitate the placement of sequential multi-axis robots 10 arranged directly next to one another with minimal distance and an ability to operate separately without mutually hindering each other.

Multi-axis robot 10 having end effector 40 provided as mandrel 60 cooperatively associated thereto can be provided in a configuration that is either in not in connective engagement with frame 112 or not in connective engagement with frame 112. In other words, positionable roll grasping apparatus 100 (provided as multi-axis robot 10 having end effector 40 provided as mandrel 60 cooperatively associated thereto) can be provided with a support assembly for mount 15 that is not physically attached to frame 12, but is capable of providing first and second web materials 122, 124 in cooperative and connective engagement with any of the components of unwind stand 110. This can include frame 112, splicer 114, first and/or second dancers (not shown), first and second metering rolls (not shown), or any of idler rollers 116, 118 disposed upon frame 112. Each axis of motion of multi-axis robot 10 having end effector 40 provided as mandrel 60 cooperatively associated thereto can be generated by a brush type DC electric motor, with axis position feedback generated by incremental encoders. By way of example only, multi-axis robot 10 having end effector 40 provided as mandrel 60 cooperatively associated thereto cart be provided with any number of articulations, including an up/down rotation, a left/right rotation, a third motion, up and down elbow and shoulder rotations, and a left/right arm rotation on the base 15 of multi-axis robot 10.

In one embodiment, a convolutley wound roll of the first web material 122 may be mounted on the mandrel 60. The convolutley wound roll of the first web material 122 may be rotatable in either a clockwise and/or counter clockwise direction. The first web material 122 may be unwound from the convolutley wound roll and fed into, and passed through, the splicer 114. Once passing through the splicer 114, the first web material 122 may enter the lattice 120. As illustrated, the web material 122 may be looped over a roller 116 and then extend to a roller 118 thereby forming a "festoon."

As will be appreciated upon consideration of this disclosure, the distance between the rollers 116 and the rollers 118 can be increased, thereby increasing the linear amount of the web material 122 engaged in the lattice 120. Additionally, the number of rollers 116, 118 used in the lattice 120 can also determine the linear amount of the first web material 122 engaged in the lattice 120. After passing through the lattice 120, the first web material 122 may proceed in the machine direction towards the first metering roll or any downstream operation suitable for the production of disposable absorbent articles such as diapers and catamenial devices. After engaging with first metering roll or other downstream device, the first web material 122 may be further directed toward any additionally desired downstream equipment.

A convolutley wound roll of the first web material 122 can be mounted to the mandrel 60. The convolutley wound roll of the first web material 122 may be configured to rotate in a clockwise and/or counterclockwise direction. In the illustrated embodiment, the convolutley wound roll of the second web material 124 can serve as a stand-by roll for the splicer 114, and therefore the second convolutley wound roll of web material 124 may be the same type as the convolutley wound roll of the first web material 122. In some embodiments, it may be advantageous to provide convolutley wound roll of the second web material 124 as a different web material than convolutley wound roll of the first web material 122 in order to allow for the ability to rapidly change web material types without having to actually remove the given web material before changing over to different product constructions. In other embodiments, however, the convolutley wound roll of the first web material 122 may bypass the splicer 114 and/or may be a different web material than convolutley wound roll of the second web material 124. As used herein, splicing (and splicing means) refers to any process of joining, or any apparatus or equipment associated with or necessary to join, a first web material to a second web material, such as joining the convolutley wound roll of the first web material 122 to the convolutley wound roll of the second web material 124. As used herein, a splice is considered to be the combined localized portions of a first web material and a second web material that are joined together.

The first and second convolutley wound rolls of web material 122, 124 that may be spliced (with splicing means) can include, without being limiting, non-woven materials, paper webs including tissue, towel and other grades of paper, absorbent materials, plastic films and metal films. The splicer 114 may be adapted to splice the web material of any suitable width and thickness. Web material ranging in width from a few millimeters to about several meters may be processed by an appropriately sized splicing apparatus. Similarly, web material ranging in thickness from a few thousandths of a millimeter to several millimeters may be spliced by an appropriately adapted splicer 144.

It should be understood that first and second convolutley wound rolls of web materials 122, 124, such as thermoplastic material, can be added to the line operation in an alternating fashion in the above described manner whenever a low roll amount is detected, thereby allowing the line to run continuously. It should also be understood that while the method and apparatus of the present invention have been described with reference to first and second web materials, it is intended that multiple rolls of web materials will be spliced together over time to keep the line running. Further, it is contemplated that the first and second web materials need not be made from the same web material as long as the web materials used for the first and second webs are compatible from a splicing standpoint. Due to the ability to continuously run the line operation according to the teachings of the present invention, products can be manufactured with minimal manufacturing down-time. Further, lattice 120 may serve as an accumulator during a zero-speed splice and may also serve as part of a dancer roll in order to facilitate and/or alter the line tension of the web materials 122, 124.

First and second convolutley wound rolls of web materials 122, 124 can be provided to the multi-axis robot 10 having end effector 40 provided as mandrel 60 cooperatively associated thereto through means known to those of skill in the art. For example, first and second convolutley wound rolls of web materials 122, 124 can be provided to the multi-axis robot 10 having end effector 40 provided as mandrel 60 cooperatively associated thereto through the use of carts (not shown). By way of example only, carts can be provided with a quantity of convolutely wound rolls of web material suitable for use as first and second web materials 122, 124.

During operation, the splicer 114 may perform a zero-speed splice of a tail end of the first web material 122 to the leading (or beginning) end of the second web material 124 while simultaneously continuing to deliver the first web material 122 to any downstream converting equipment. During a splicing operation, the lattice 120 may move in order to serve as an accumulator and increase the linear amount of the first web material 122 engaged in lattice 120. When the convolutley wound roll of the first web material 122 stops spinning, the arm moves or pivots and the first web material 122 is drawn out of the lattice 120 to supply the downstream equipment. Therefore, the splicer 114 may splice the first web material 122 to the second web material 124 while the rolls of the lattice 120 are stopped, yet the first web material 122 can continue to be delivered to downstream equipment without disruption. Once the splice has been performed, the mandrel 60 may be rotated by an actuator to unwind the web material from the convolutley wound roll of second web material 124. As will be appreciated, once the second web material 124 is unwinding from the convolutley wound roll of second web material 124 and supplying web material to the downstream equipment, a replacement roll may be loaded onto an opposed mandrel 60, with material from that replacement roll fed into the splicer 114 and positioned to serve as a standby roll.

The splice between the first web material 122 and the second web material 124 may be accomplished by any means known in the art. The nature of the splice may be related to the nature of the particular web material being spliced. In one embodiment two convolutley wound rolls of the web materials 122, 124 can be spliced together by using two-sided splicing tape having adhesive on each side of the tape. In this embodiment, the two-sided splicing tape is affixed first to the first web material 122 and then to a second web material 124. Pressure may be applied to the portion of the two web materials 122, 124 after the application of the two-sided splicing tape. In another embodiment two web materials 122, 124 may be joined by applying an adhesive directly to the first web material 122 and then bringing the second web material 124 into contact with the adhesive. Pressure may be applied to the two web materials 122, 124 at the location of the adhesive to assist in the joining of the web materials 122, 124.

In another embodiment two web materials 122, 124 may be brought into a face-to-face relationship and then subjected to sufficient pressure to bond the two web materials 122, 124 together. In this embodiment, the two web materials 122, 124 may be subjected to sufficient pressure to glassine the two web materials 122, 124 creating a bond sufficient to withstand the process tension applied to the spliced web material.

In another embodiment the two web materials 122, 124 may be brought into a face-to-face relationship and exposed to a bonding means. Bonding means include without being limiting, exposure to infra-red or other electromagnetic radiation to heat and fuse the first and second web materials 122, 124, ultrasonic energy applied from an appropriately adapted ultrasonic horn to the combined web material against an anvil to heat and fuse the first and second web materials 122, 124 together, and the spray application of a solvent to fuse the first and second web materials 122, 124.

Incorporating a mandrel 60 as discussed supra can provide the ability for the multi-axis robot 10 to be positionable to locate a new convolutely wound rolls of web material 122, 124 or similarly locate the core of a new convolutely wound rolls of web material 122, 124. In this fashion, the multi-axis robot 10 with end effector 40 having mandrel 60 can engage the core of the convolutely wound rolls of web material 122, 124 and utilize suitable pneumatics (discussed supra) to engage and secure the new roll of convolutely wound roll of web material 122, 124.

The multi-axis robot 10 can then move the convolutely wound roll of web material 122, 124 secured thereto to a load position relative to a desired location suitable for a converting operation such as splicer 114, lattice 120, or the like. Upon the proper positioning of convolutely wound rolls of web material 122, 124 disposed upon robot 10/end effector 40 relative to the load position, stationary motor 65 can engage rotational coupling 55 to cause mandrel 60 to rotate relative to the desired converting operation causing the material comprising convolutely wound rolls of web material 122, 124 to be unwound from convolutely wound rolls of web material 122, 124 and directed toward the desired converting operation.

As required an automated or non-automated system can present the leading edge of the material comprising convolutely wound roll of web material 122, 124 to the splicer 114 or other desired converting operation. As required, one of skill in the art can cause robot 10 and/or mandrel 60 to further position convolutely wound roll of web material 122, 124 relative to the converting operation as well as provide the required tension to the material comprising convolutely wound rolls of web material 122, 124. In a typical converting operation, the material from convolutely wound roll of web material 122, 124 can be spliced together with a tail end of a previously used or currently used convolutely wound roll of web material 122, 124 by splicer 114 and then utilized as required by the demands of the converting operation.

During the unwinding process, it is believed that the position of multi-axis robot 10 can be adjusted as necessary. Movement of convolutely wound roll of web material 122, 124 during unwinding can facilitate the creation of the space necessary for a second multi-axis robot 10 to position yet another convolutely wound roll of web material 122, 124 proximate to splicer 114, for example. As the currently unwinding convolutely wound roll of web material 122, 124 approached the end of the material disposed thereon due to unwinding, the new convolutely wound roll of web material 122, 124 can be joined to the currently unwinding convolutely wound roll of web material 122, 124 in a fashion consistent with that as described supra. After such a splice event, the multi-axis robot 10 having a mandrel 60 cooperatively attached thereto can then dispose of the remains of the previously roll of convolutely wound roll of web material 122, 124 as required by the manufacturing operation, such as a disposal bin.

All publications, patent applications, and issued patents mentioned herein are hereby incorporated in their entirety by reference. Citation of any reference is not an admission regarding any determination as to its availability as prior art to the claimed invention.

The dimensions and/or values disclosed herein are not to be understood as being strictly limited to the exact numerical values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that an meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An unwind apparatus for obtaining, loading, splicing, and unwinding convolutely wound rolls of web material and forwarding said web material unwound from each of said convolutely wound rolls uninterruptedly to a downstream apparatus, said unwind apparatus comprising:

a. a multi-axis robot; and, b. an end effector operatively connected to said multi-axis robot, said end effector comprising:

a. a stationary motor;

b. a rotational coupling mechanically coupled to said stationary motor; and, c. a mandrel mechanically coupled to said rotational coupling, said mandrel being capable of releasably engaging said convolutley wound rolls of web material, wherein said mandrel comprises a first plurality of spaced apart mandrel arms configured to enable interleaving of a second mandrel comprising a second plurality of spaced part mandrel arms that can be interlaced with the first plurality of mandrel arms.

2. The unwind apparatus of claim 1 wherein said multi-axis robot further comprises an articulable arm, said end effector being cooperatively engaged with said articulable arm.

3. The unwind apparatus of claim 2, wherein said multi-axis robot further comprises control means for controlling said multi-axis robot so as to effect movement of said multi-axis robot away from said downstream apparatus and to effect coordinated movement of said multi-axis robot while said mandrel is engaged with said convolutely wound rolls of web material so that said convolutely wound rolls of web material are capable of being moved relative to said downstream apparatus.

4. The unwind apparatus of claim 1, wherein said end effector further comprises roll grasping means operably attached to said mandrel for grasping a convolutely wound roll of web material.

5. The unwind apparatus of claim 4, wherein said roll grasping means further comprises an arm movable radially toward and radially away from said mandrel.

6. The unwind apparatus of claim 4 wherein said roll grasping means is adapted to revolvingly unwind said convolutely wound roll of web material.

7. The unwind apparatus of claim 1, wherein said multi-axis robot further comprises means for operating said multi-axis robot so as to effect engagement and disengagement of said multi-axis robot with said convolutely wound rolls of web material.

8. The unwind apparatus of claim 1 wherein said end effector is capable of autonomously determining a characteristic of each of said convolutely wound rolls of web material, said characteristic of each of said convolutely wound rolls of web material being selected from the group consisting of convolutely wound roll of web material roll diameter, convolutely wound roll of web material core region diameter, convolutely wound roll of web material type of material, convolutely wound roll of web material physical characteristic(s), and combinations thereof.

9. The unwind apparatus of claim 1 wherein said unwind apparatus positions said convolutely wound rolls of web material while said convolutely wound rolls of web material are unwinding.

10. The unwind apparatus of claim 9 wherein said unwind apparatus orients said convolutely wound rolls of web material in at least 3 axis.

11. The unwind apparatus of claim 9 wherein said unwind apparatus positionably rotates said convolutely wound rolls of web material in at least 3 axis.

12. The unwind apparatus of claim 1 wherein the first plurality of spaced apart mandrel arms comprises mandrel arms arranged triangularly about the mandrel's longitudinal axis.

13. An end effector for an unwind apparatus for obtaining, loading, splicing, and unwinding convolutely wound rolls of web material and forwarding said web material unwound from each of said convolutely wound rolls uninterruptedly to a downstream apparatus, said end effector comprising:

a. a stationary motor;

b. a rotational coupling mechanically coupled to said stationary motor; and, c. a mandrel mechanically coupled to said rotational coupling, said mandrel being capable of releasably engaging said convolutley wound rolls of web material, wherein said mandrel comprises a first plurality of spaced apart mandrel arms configured to enable interleaving of a second mandrel comprising a second plurality of spaced part mandrel arms that can be interlaced with the first plurality of mandrel arms.

14. The end effector of claim 13, wherein said end effector further comprises roll grasping means operably attached to said mandrel for grasping a convolutely wound roll of web material.

15. The end effector of claim 14, wherein said roll grasping means further comprises an arm movable radially toward and radially away from said mandrel.

16. The end effector of claim 14 wherein said roll grasping means is adapted to revolvingly unwind said convolutely wound roll of web material.

17. The end effector of claim 13 wherein said end effector is capable of autonomously determining a characteristic of each of said convolutely wound rolls of web material, said characteristic of each of said convolutely wound rolls of web material being selected from the group consisting of convolutely wound roll of web material roll diameter, convolutely wound roll of web material core region diameter, convolutely wound roll of web material type of material, convolutely wound roll of web material physical characteristic(s), and combinations thereof.

18. The end effector of claim 13 wherein said end effector is connectively and cooperatively engagable with a multi-axis robot.

19. The end effector of claim 13 wherein said mandrel further comprises and elongate mandrel arm having at least one expansion element disposed thereon, said at least one expansion element being radially expandable into cooperative engagement with a core region disposed within each of said convolutely wound rolls of web material.

20. The end effector of claim 13 wherein said rotational coupling is off-set mechanically coupled to said stationary motor.

21. The end effector of claim 13 wherein the first plurality of spaced apart mandrel arms comprises mandrel arms arranged triangularly about the mandrel's longitudinal axis.

* * * * *